US005922994A

United States Patent [19]

Robinson, Sr. et al.

[11] Patent Number: 5,922,994

[45] Date of Patent: Jul. 13, 1999

[54] WIRE CONNECTOR

[76] Inventors: James H. Robinson, Sr., 179 Sherwood Dr., Lexington, S.C. 29073; Walter W. Wells, 219 River Crossing, Lexington, S.C. 29072

[21] Appl. No.: 08/975,608

[22] Filed: Nov. 21, 1997

Related U.S. Application Data

[60] Provisional application No. 60/057,107, Aug. 27, 1997, abandoned.

[51] Int. Cl.[6] ..... H01R 4/22

[52] U.S. Cl. ..... 174/87

[58] Field of Search ..... 174/87; 403/214, 403/396; 439/840

[56] References Cited

U.S. PATENT DOCUMENTS

| | | | |
|---|---|---|---|
| 1,577,123 | 3/1926 | Hunt . | |
| 1,626,875 | 5/1927 | Reiser . | |
| 1,896,322 | 2/1933 | Marr . | |
| 2,788,384 | 4/1957 | Gay . | |
| 2,823,249 | 12/1958 | Curtiss . | |
| 2,872,505 | 2/1959 | Ustin . | |
| 2,910,525 | 10/1959 | Frank | 174/87 |
| 2,965,700 | 12/1960 | Kusiv . | |
| 3,010,745 | 11/1961 | Blomstrand et al. | 174/87 X |
| 3,113,553 | 12/1963 | Schinske | 174/87 X |
| 3,676,574 | 7/1972 | Johansson et al. | 174/87 |
| 4,295,004 | 10/1981 | Dauser, Jr. . | |
| 4,446,332 | 5/1984 | Dauser, Jr. . | |
| 4,883,921 | 11/1989 | Legerius et al. . | |
| 5,099,089 | 3/1992 | Zan | 174/87 |
| 5,132,494 | 7/1992 | Burton et al. | 174/87 |
| 5,179,253 | 1/1993 | Munniksma et al. . | |

*Primary Examiner*—Kristine Kincaid
*Assistant Examiner*—Chau N. Nguyen
*Attorney, Agent, or Firm*—Michael A Mann; Nexsen Pruet Jacobs & Pollard LLP

[57] ABSTRACT

A wire connector is disclosed that has a removable cap to provide access to the connected wires for testing purposes. The connector includes a hollow body with a wide end and a narrow end, openings to the interior of the hollow body in each end, an electrically conducting spring inserted inside the body, and a cap threadably receivable on the narrow end of the body. The cap has a plug that fits into the hole in the narrow end of the body to limit the advance of the electrical conductors inserted into the wire connector. The spring in the body has a neck that operates in combination with the cap's plug to limit conductor advance. The cap can be made in colors different from that of the body so that it can serve as a code to identify the circuit to which the wires belong. The cap may be formed with different styled surface features that help gripping. The style of the surface features may be matched to the preference of the user since the caps are interchangeable.

11 Claims, 4 Drawing Sheets

2
14
10
20
12
22
24
26
2

2
14
20
12
22
24
10
26
2

50
14
70
40
10
32
34
20
36
38
64
22
24
26

14
34
40
50
60
54
62
20
56
16
12
38

WIRE CONNECTOR

This application claims the benefit of U.S. Provisional Application No. 60/057,107, filed Aug. 27, 1997 now abandoned.

FIELD OF THE INVENTION

The present invention relates generally to wire connectors used for joining two or more wires carrying an electrical current. More specifically, the present invention relates to a wire connector that is formed to permit testing of the wires without removal of the connector and color-coded for prompt identification of the nature of the circuit.

BACKGROUND OF THE INVENTION

Wire connectors are used for joining wires and cables quickly and for covering the ends of the joined wires to reduce the potential for the wires to touch other wires, metal surfaces or people. Wire connectors are manufactured in various forms. In their earliest form, the sleeve of a connector was made of porcelain and was normally provided with grip-enhancing flutes. The narrow end of the sleeve was enclosed and at times was formed to receive a hexagonal wrench.

Modem connectors are typically made of plastic or other non-electrically conducting material and have a tightly coiled spring inside that helps to hold the wires, to twist them on insertion into the connector, and to assure good electrical contact among the wires.

When joining wires, the ends of the wires are first stripped of insulation and may be twisted or bunched together. The bared ends are inserted into the connector and the connector then twisted as the wires are pushed into it. The spring inside the wire connector may be made with a square or diamond-shaped cross section so that it acts as metal threading on the inside of the connector, resisting accidental loosening of the connector.

Although they serve a safety function and are handy, present wire connectors are not totally satisfactory. Even in circumstances requiring a modest amount of wiring, a junction box can have a bewildering array of wire connectors, each connecting two or three or more wires. Identification of the right wire in such a box can be a time consuming task that is not always immediately successful. If the wires are to be tested to determine, for example, if they are receiving current, the wire connector should be removed, because inserting a test probe under the cap will not assure that good contact has been made. However, when the wire connector is removed, the wires it covered are then exposed. Moreover, the circuits will be disturbed in many cases as well.

There have been a number of attempts to address the problems of wire connectors. One such attempt was made by Legerius et al. in U.S. Pat. No. 4,883,921. They describe a wire connector having a hole in the top that is intended to provide access to the interior for testing, thus obviating the need for removal of the connector. A metal ball located near the top of the body and resting on the metal spring is intended to allow contact between a test probe and the wires inside. However, this device is also unsatisfactory. For example, dust and dirt accumulating in the hole at the top of the connector body can prevent good contact with the ball.

Thus there remains a need for a more effective wire connector.

SUMMARY OF THE INVENTION

According to its major aspects and broadly stated, the present invention is a wire connector comprising a body, a spring and a cap. By removing the cap from the body, the wires on the inside can be probed without the need to remove the wires from the body of the connector. The cap threads to the body and helps by its shape, in combination with the shape of the spring, to keep the wires inside the body. A threaded depending flange on the body helps to keep the spring centered just below the hole in the top of the body covered by the cap and where the test probe would be inserted. Finally, the cap can be used as a convenient color-code carrying device to make identification of circuits faster.

The cap is an important feature of the present invention. The cap serves multiple functions. First, because it is removable, it will allow access to the interior of the body of the connector without the need for removing the wires from the connector, and it will help to keep the interior of the body of the connector clean. The cap also controls the position of the ends of the wires by limiting the advance they make into the connector body. Limiting advance is important for assuring that when the cap is removed, bare wires are not too close to the end of the connector.

Another important feature of the present invention is the color-coding of the caps. The coding system allows a technician to quickly and easily identify each circuit in a junction box where there may be multiple circuits. Preferably, four colors are used, three for power circuits and one for control circuits. This features not only saves time and money in tracing circuits but is also a safety feature.

The spring shape is still another important feature of the present invention. The spring is shaped to have a narrow neck and a small flare at the top. The neck in combination with the cap helps to limit the advance of the wires to the neck and also helps to twist the wires together for good contact. The flare encircles the flange at the top of the connector body to center the spring, and thus center the wires in the opening of the body for testing.

Another important feature of the present invention is the interchangability of different styled caps. The cap may be formed with different styled surface features that facilitate twisting the cap on and off the body of the connector. The style of the surface features may be matched to the preference of the user since the caps are interchangeable.

Finally, the threaded flange of the body is another feature of the present invention. The threaded flange helps to hold the spring in place in the body.

Other features and their advantages will be apparent to those skilled in the art to which the present invention pertains from a careful reading of the Detailed Description of Preferred Embodiments accompanied by the following drawings.

DETAILED DESCRIPTION OF PREFERRED EMBODIMENTS

Figure 1A:
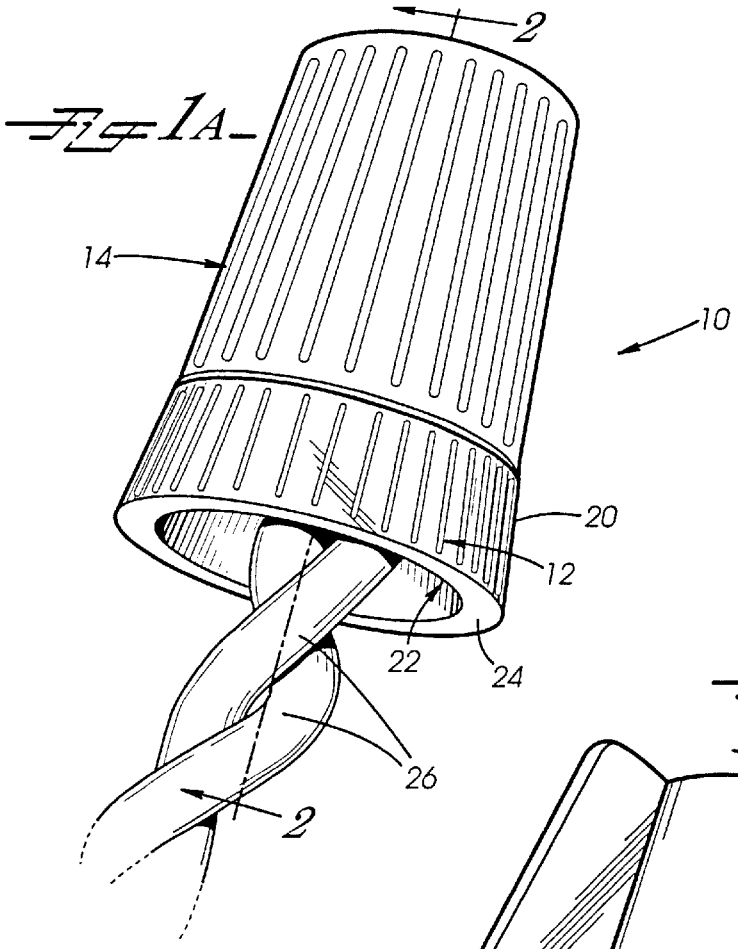
FIG. 1A is a perspective view of a wire connector according to a preferred embodiment of the present invention.

Referring now to the figures, the present invention is a wire connector for use in joining two or more electrical conductors such as wires or cables. A wire connector according to the present invention is referred to generally in the figures using reference number 10. Connector 10 comprises a body 12, a cap 14 and a spring 16.

Body 12 is preferably tapered and has one or more surface features on its exterior surface 20 that facilitate gripping for twisting and holding the body 12 while the cap is removed. Body has a first hole 22 at the wide end 24 that receives two or more electrical conductors 26, such as wires or cables, and a second hole 32 at the opposing, narrow end 34 that receives cap 14. Second hole 32 is dimensioned to have a diameter larger than standard probes and is preferably tapered to guide a probe into it.

A flange located preferably midway between the narrow end 34 and the wide end 24 has exterior threads 38 that engage interior threads 40 on cap 14. The engagement of exterior threads 38 of flange 36 with interior threads 40 of cap 14 holds cap 14 in place on body 12, covering second hole 32.

Figure 1B:
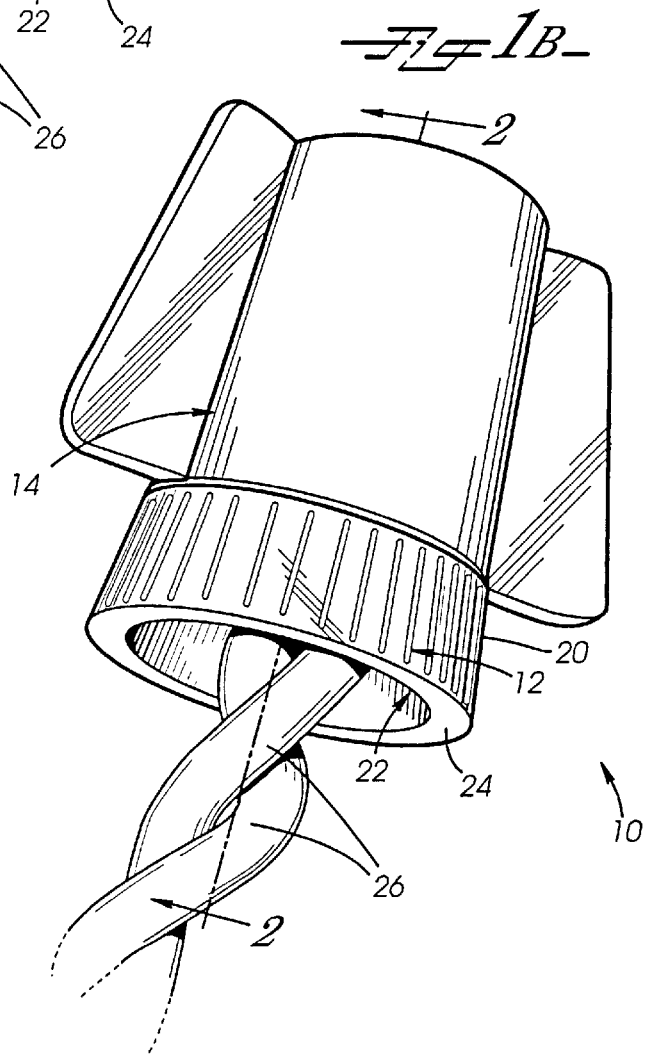
FIG. 1B is a perspective view of a wire connector according to an alternative embodiment of the present invention.
Figure 2A:
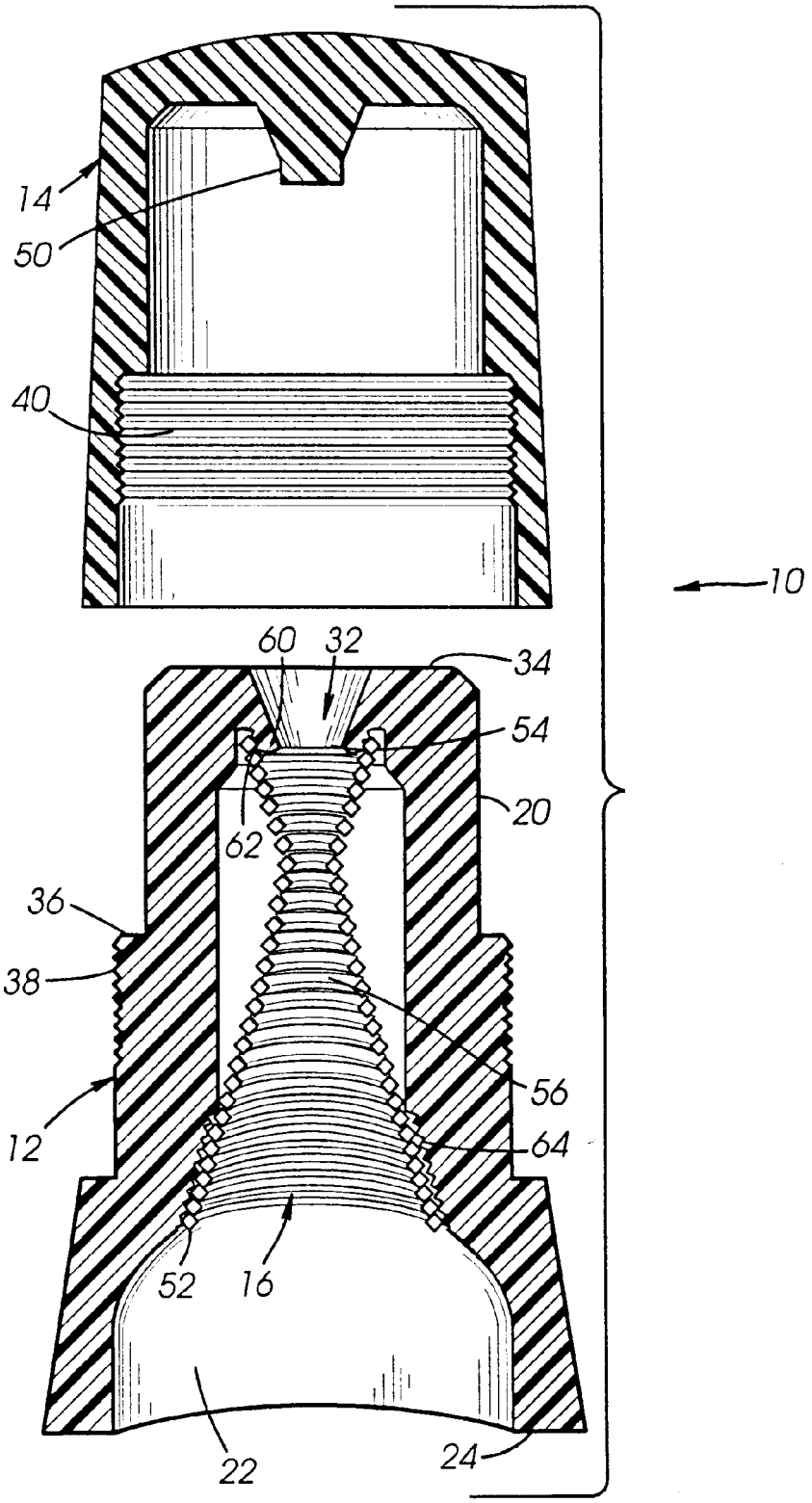
FIG. 2A is an exploded cross-sectional view of a wire connector according to a preferred embodiment of the present invention.
Figure 2B:
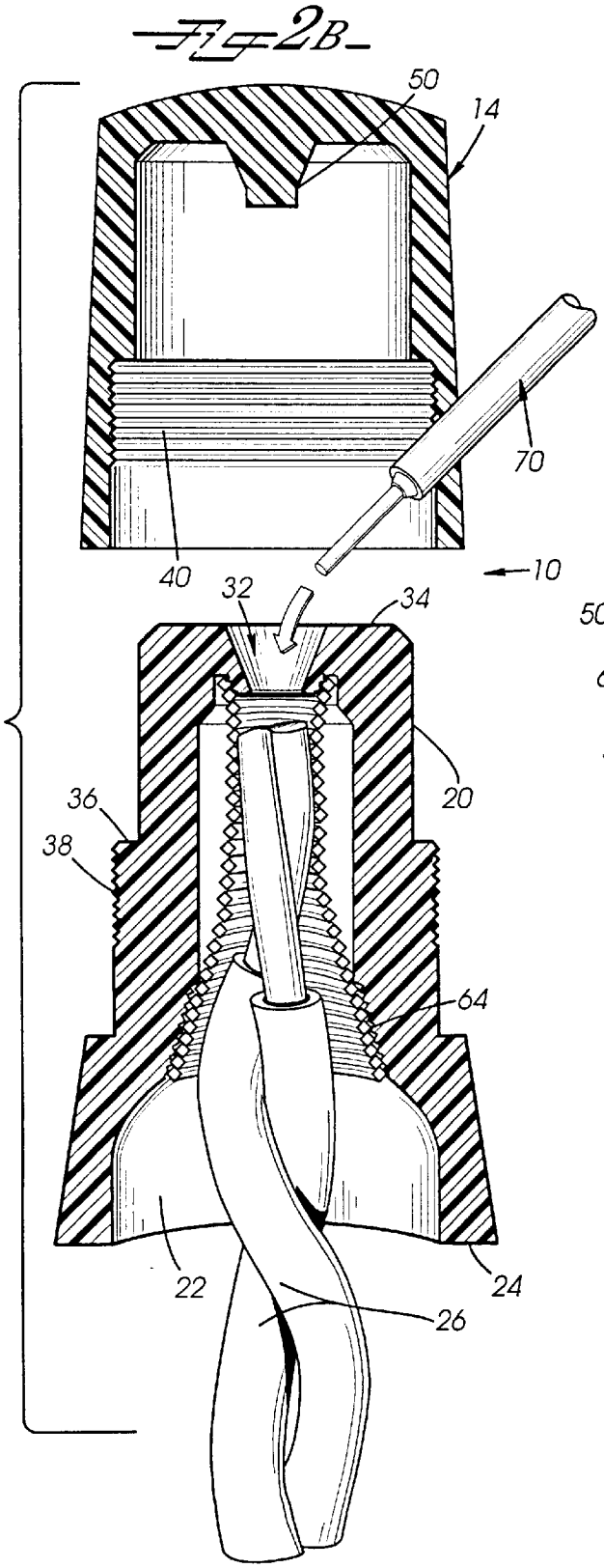
FIG. 2B is a cross-sectional view of the wire connector shown in FIG. 2A, with the cap removed for access by a probe lead.
Figure 3:
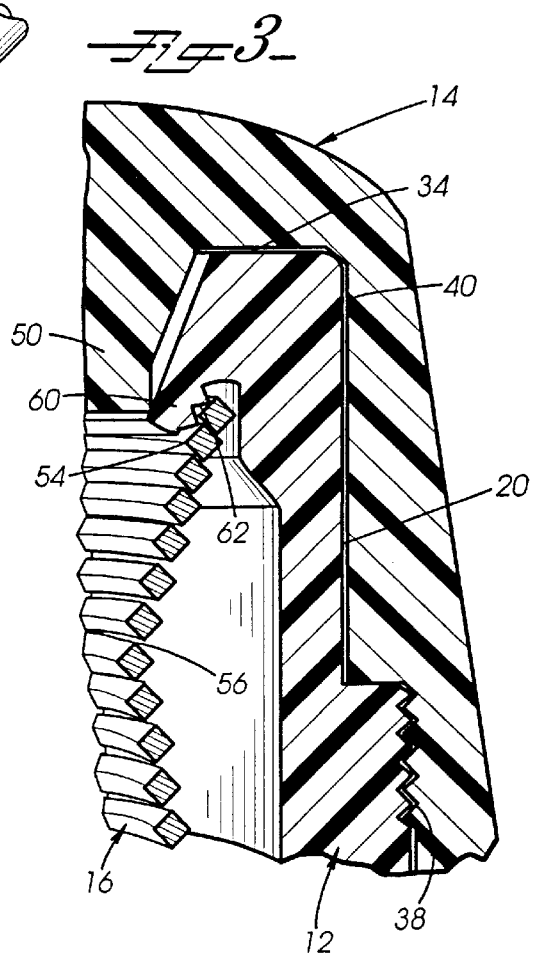
FIG. 3 is a detailed cross-sectional view of the wire connector shown in FIG. 2A.
Figure 4A:
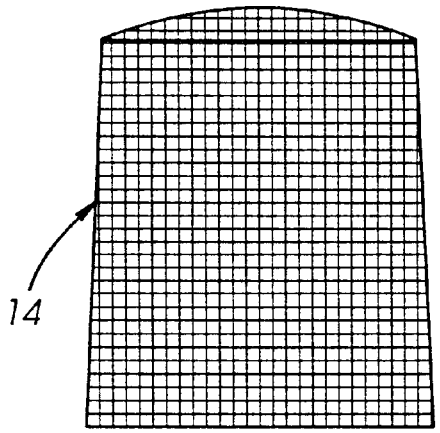
FIG. 4A is a front view of the cap showing the cap color coded black according to a preferred embodiment of the present invention.
Figure 4B:
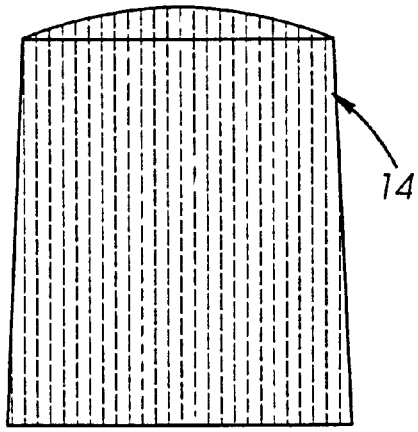
FIG. 4B is a front view of the cap showing the cap color coded purple according to a preferred embodiment of the present invention.
Figure 4C:
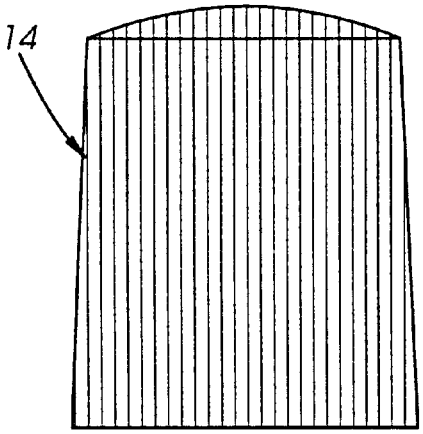
FIG. 4C is a front view of the cap showing the cap color coded pink according to a preferred embodiment of the present invention.
Figure 4D:
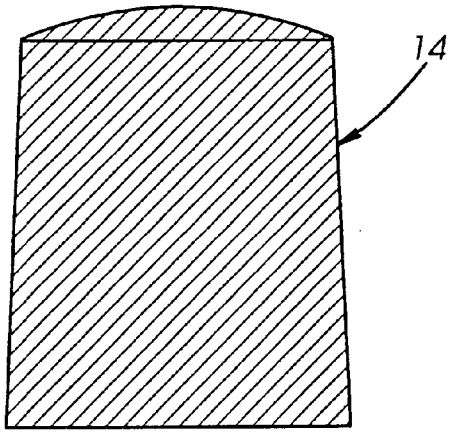
FIG. 4D is a front view of the cap showing the cap color coded tan according to a preferred embodiment of the present invention.

One or more surface features on cap 14 facilitate gripping for twisting. In the preferred embodiment, the surface features of cap 14 may contain depressions as illustrated in FIG. 1A. Instead, the exterior surface of cap 14 may be formed with wings as illustrated in FIG. 1B. Moreover, many other styles of surface features may be used to aid gripping; however, the body 12 can accept any cap 14 regardless of the cap 14 style.

Cap 14 also has a plug 50 depending from its interior and which is dimensioned to fit snugly into second hole 32. Plug 50 prevents the advance of electrical conductors 26 through second hole 32 and holds them at a distance from narrow end 34 of body 12.

Spring 16 is a tightly coiled spring made of a good electrical conductor, such as steel or aluminum or alloys of these. Its coils may have a square or round cross-section but are preferably square so that their inner edge can get a purchase on the electrical connectors and on the material of body 12, which is preferably a non-electrically conducting material such as plastic. Spring 16 is conically shaped and positioned so that its wide end 52 is close to wide end 24 of body 12. Spring 16 has a flared end 54 opposite wide end 52 and a neck 56 therebetween. Flared end 54 is narrower than wide end 52 but wider than neck 56. Plug 50 extends to a point just short of neck 56 and cooperates with it in preventing conductors 26 from extending beyond second hole 32, and preferably, limiting the advance of electrical conductors 26 to a distance spaced apart from narrow end 34 when connector 10 is twisted onto conductors 26.

Flared end 54 of spring 16 engages a depending flange 60 of body 12 that is located near narrow end 34 on the interior surface 22 of body 12. Flange 60 has threads 62 that engage the coils of spring 16 at flared end 54 to help hold spring 16 inside body 12. The interior of body 12 has threads 64 that engage the wide end 52 of spring 16.

Cap 14 need not be the same color as body 12. Prior art wire connectors are often color coded, but the color is keyed to the power rating of the connector or the brand and not, for example, to the type of circuit. Because cap 14 is separate from body 12, the present invention permits the cap to carry additional information about a circuit by way of a color code. In the preferred embodiment, the cap 14 carries one of four colors depending upon the nature of the circuit. Preferably the colors black, purple, pink, and tan represent connections to motors, non-motor devices, lighting circuits, and control circuit devices, respectively as illustrated in FIGS. 4A–4D. The colored caps also help distinguish between control circuits which are color coded tan and power circuits which are either black, purple or pink. Color-coded caps can make it much quicker and easier to identify a particular circuit among a number of others in a junction box. The four colors identified above are preferred but are not the only possibilities. However, they are easily distinguishable by a large number of individuals including those with the most common type of color-blindness (red/green color vision deficiency) and are not in conflict with wire connector body colors. The code is very useful to electricians because nearly every circuit that they use will, in a general way, fit into one of the four selections that have been chosen and represented by a certain color.

Preferably cap 14 is made of a uniformly colored plastic but, alternatively, it can be painted or coated with a colored paint or coating. Other types of coding in lieu of color coding or in addition to color coding, such as surface features, can be used.

In use, the ends of a group of wires or cables are stripped of insulation, leaving the bare electrical conductors 26. These are bunched or twisted together and inserted into first hole 22 in wide end 24 of body 12. Body 12 is twisted over them by applying force to the cap 14 while they are pushed into first hole 22. If the circuit needs to be tested, cap 14 is removed by rotating it opposite the direction of its threads to reveal second hole 32. A probe 70 is inserted into second hole 32 far enough to engage electrical connectors 26 or spring 16 or both. Body 12 does not need to be removed. By simply looking at the color of the caps, a technician will be able to easily determine whether if a connector is connected to a motor, non-motor device, lighting circuit, or control circuit device. Moreover, the technician can easily distinguish between controller and power circuits using the color coding.

It will be apparent to those skilled in the electrical arts that many modifications and substitutions can be made without departing from the spirit and scope of the present invention.

What is claimed is:

1. A wire connector for joining two or more electrical conductors, said wire connector comprising:

a hollow body having a first end and an opposing second end;

a cap that is removably attachable to said second end of said hollow body; and means carried within said hollow body for assuring electrical connection between electrical conductors when said electrical conductors are inserted into said hollow body, said assuring means and said cap cooperating to prevent electrical conductors from extending from said second end of said hollow body when said electrical conductors are inserted into said first end of said hollow body, said removable cap, when removed from said second end of said hollow body and when electrical conductors are inserted in said first end of said hollow body, providing access to said electrical conductors for testing, said body having a threaded flange positioned between said first end and said second end wherein said cap carries interior threads that threadably engage said treaded flange when said cap is rotated with respect to said body.

2. The wire connector as recited in claim 1, wherein said assuring means is a conical-shaped spring having a first end, a second end and a middle therebetween, said first end of said spring being wider than the middle of said spring and said second end being flared.

3. The wire connector as recited in claim 1, wherein said second end is tapered.

4. A wire connector for joining two or more electrical conductors, said wire connector comprising:

a hollow body having a first end and an opposing second end;

a cap that is removably attachable to said second end of said body;

a plug carried by and depending from said cap so that said plug projects into said second end of said body; and a spring having a first end and an opposing second end, and positioned inside said body, said spring and said cap cooperating to prevent electrical conductors from extending from said second end of said hollow body when said electrical conductors are inserted into said first end of said hollow body, said removable cap, when removed from said second end of said hollow body and when electrical conductors are inserted in said first end of said hollow body, providing access to said electrical conductors for testing, and said body having a threaded flange positioned between said first end and said second end, and said cap carries interior threads that engage said threaded flange by pressure contact when said cap is rotated with respect to said body.

5. The wire connector as recited in claim 4, wherein said plug and said second end are both tapered.

6. The wire connector as recited in claim 4, wherein said spring is conical in shape, said first end of said spring being wider than the middle of said spring and said second end being flared.

7. The wire connector as recited in claim 4, wherein said cap carries surface features for gripping said cap.

8. A wire connector for joining two or more electrical conductors that are connected to an electrical circuit, said wire connector comprising:

a hollow body having a first end and an opposing second end;

a cap that is removably attachable to said second end of said hollow body;

identification means, carried by said cap, for identifying the nature of said circuit to which said electrical conductors are connected;

a plug carried by and depending from said cap so that said plug projects into said hollow body from said second end; and a spring, having a first end and a second end and being positioned inside said hollow body, said spring and said cap cooperating to prevent electrical conductors from extending from said second end of said hollow body when said electrical conductors are inserted into said first end of said hollow body, said removable cap, when removed from said second end of said hollow body and when electrical conductors are inserted in said first end of said hollow body, providing access to said electrical conductors for testing, said body having a threaded flange positioned between said first end and said second end of said hollow body, and said cap carries interior threads that engage said threaded flange by pressure contact when said cap is rotated with respect to said body.

9. The wire connector as recited in claim 8, wherein said identification means is a color from a set of colors, each color of said set of colors corresponding to particular type of circuit.

10. The wire connector as recited in claim 8, wherein said plug and said second hole are tapered.

11. The wire connector as recited in claim 8, wherein said spring is conical in shape so that said first end is wider than the middle and said second end is flared.

* * * * *